US007465877B2

(12) United States Patent
Jurek

(10) Patent No.: US 7,465,877 B2
(45) Date of Patent: Dec. 16, 2008

(54) SHIELDED FLAT CABLE AND METHOD OF PRODUCING SUCH A FLAT CABLE

(75) Inventor: Gilles Jurek, Plaisance du Touch (FR)

(73) Assignee: Continental Automotive France, Toulouse (FR)

( * ) Notice: Subject to any disclaimer, the term of this patent is extended or adjusted under 35 U.S.C. 154(b) by 192 days.

(21) Appl. No.: 11/637,145

(22) Filed: Dec. 12, 2006

(65) Prior Publication Data

US 2007/0131446 A1 Jun. 14, 2007

(30) Foreign Application Priority Data

Dec. 13, 2005 (FR) ..... 05 12580

(51) Int. Cl.
*H01B 7/00* (2006.01)

(52) U.S. Cl. ..... 174/110 R; 174/117 R; 174/117 F; 174/117 FF

(58) Field of Classification Search ..... 174/110 R, 174/117 R, 117 F, 117 FF, 36
See application file for complete search history.

(56) References Cited

U.S. PATENT DOCUMENTS

| | | | | | |
|---|---|---|---|---|---|
| 3,162,717 | A | * | 12/1964 | Lentz | 174/36 |
| 4,652,772 | A | * | 3/1987 | Shephard | 307/147 |
| 4,695,679 | A | * | 9/1987 | Strauss et al. | 174/117 FF |
| 4,845,311 | A | * | 7/1989 | Schreiber et al. | 174/36 |
| 5,003,273 | A | * | 3/1991 | Oppenberg | 333/1 |
| 6,495,764 | B1 | | 12/2002 | Hori | |
| 2004/0211585 | A1 | | 10/2004 | Jordan | |

* cited by examiner

*Primary Examiner*—William H Mayo, III
(74) *Attorney, Agent, or Firm*—Young & Thompson

(57) ABSTRACT

A shielded flat cable 10 is produced by folding a structure 11 on itself at P, the structure having an upper insulating film 12, a plurality of conducting tracks 14 and a lower insulating film 13. The plurality of conducting tracks 14 include a track 15 to be protected surrounded by at least four shielding tracks 16, 17. The folded shape thus formed is maintained by connection elements 18 of the various shielding tracks 16, 17.

15 Claims, 1 Drawing Sheet

SHIELDED FLAT CABLE AND METHOD OF PRODUCING SUCH A FLAT CABLE

BACKGROUND OF THE INVENTION (1) Field of the Invention

The present invention relates to a shielded flat cable and to a method of producing such a flat cable. More particularly, it relates to a flat cable forming an antenna.

It is already known to use flat electrical cables in order to produce compact electrical connections. Such cables are commonly used in electronic computers used in the automotive field.

When such cables are used as antennas, it is necessary to protect them against electromagnetic radiation so that they do not suffer interference by any radiation emanating from the computers themselves, or from their environment.

(2) Description of Related Art

For this purpose, it is known, for example from patent U.S. Pat. No. 6,495,764, to protect flat cables by surrounding them with conducting structures called shields. However, these shields must also be protected from the external environment by a jacket (in which the shielded flat cable has to be inserted). Moreover, complex specific connections must be made in the flat cable in order to connect certain flat cables and the associated shield.

BRIEF SUMMARY OF THE INVENTION

The object of the present invention is to alleviate all these drawbacks by producing a shielded flat cable from a single and simple structure.

For this purpose, the present invention relates to a flat electrical cable shielded against electromagnetic radiation, produced from a structure comprising a plurality of flat conducting tracks that are sandwiched between a lower insulating film and an upper insulating film, said shielded flat cable being one wherein some of the flat tracks are shielding tracks designed to protect at least one electrical track against electromagnetic radiation, said shielding tracks being folded around the connection to be protected, in order to form an insulation-covered shielded flat cable.

Thus, according to the invention, starting from a conventional structure consisting of flat cables inserted between two layers of insulating material and by folding this structure onto itself, a shielded flat cable is produced in a single step (the folding step). Advantageously, the insulating films between which the flat cables to be protected are inserted also cover the shielded flat cable. It is therefore unnecessary to cover the shielded cable with an insulating jacket.

According to one advantageous embodiment, a connection is made between the shielding tracks by simply crimping these tracks together. This crimping operation ensures both electrical connection of the shielding tracks and mechanical integrity of the entire shielded cable.

Other objects, features and advantages of the present invention will also become apparent from the following description, given by way of nonlimiting example and with reference to the appended figures in which:

DETAILED DESCRIPTION OF THE INVENTION

Figure 1:
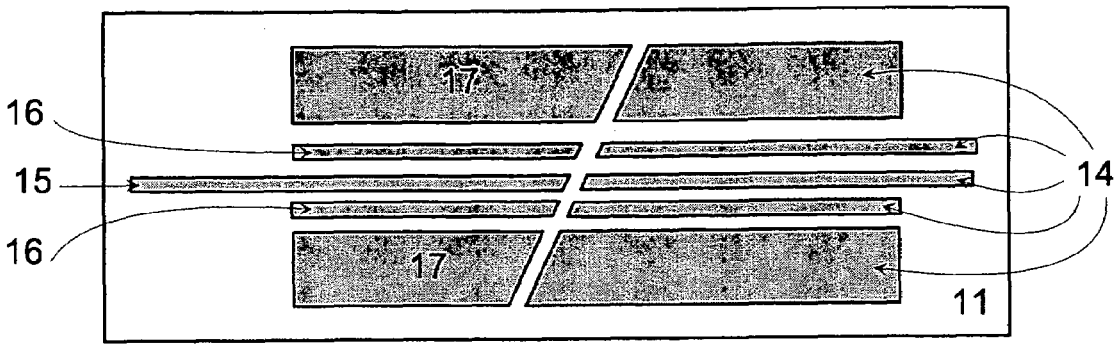
FIG. 1 is a schematic plan view of a flat cable structure (with the upper insulating film removed) designed to produce, after folding, a shielded flat cable according to the invention.
Figure 2:
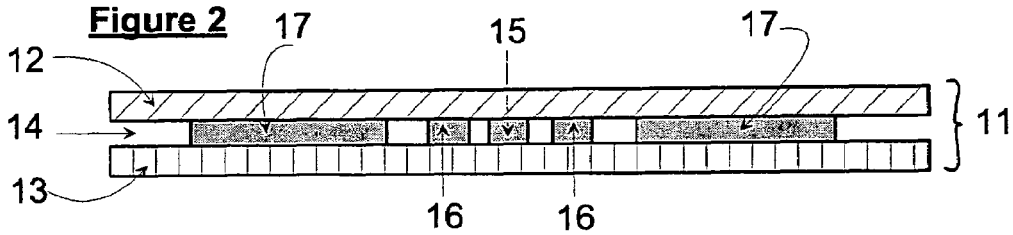
FIG. 2 is a schematic sectional view of a structure designed to form a flat cable according to the present invention.
Figure 3:
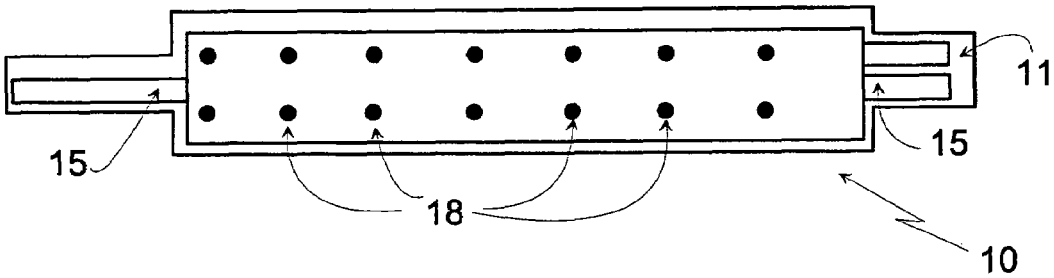
FIG. 3 is a schematic top view of a shielded flat cable according to the present invention.

According to the embodiment shown in FIGS. 1 to 4, a shielded flat cable 10 (FIGS. 3 and 4) according to the present invention is formed from a structure 11 (FIG. 2) consisting of an upper insulating film 12, a lower insulating film 13 and, placed between them, a plurality of flat conducting tracks 14. In the example shown, the conducting track 15 to be protected lies in the middle of the plurality of tracks. This track to be protected is flanked by two lateral shielding tracks 16 and by two, upper and lower, shielding tracks 17.

The structure 11 allowing the shielded cable 10 to be produced is a conventional plane structure, the particular feature of which lies in the fact that the width of the conducting tracks 14 of which the structure is composed is not identical (FIG. 1). Some of these tracks (especially the lower and upper shielding tracks 17) are wider than the others.

Figure 4:
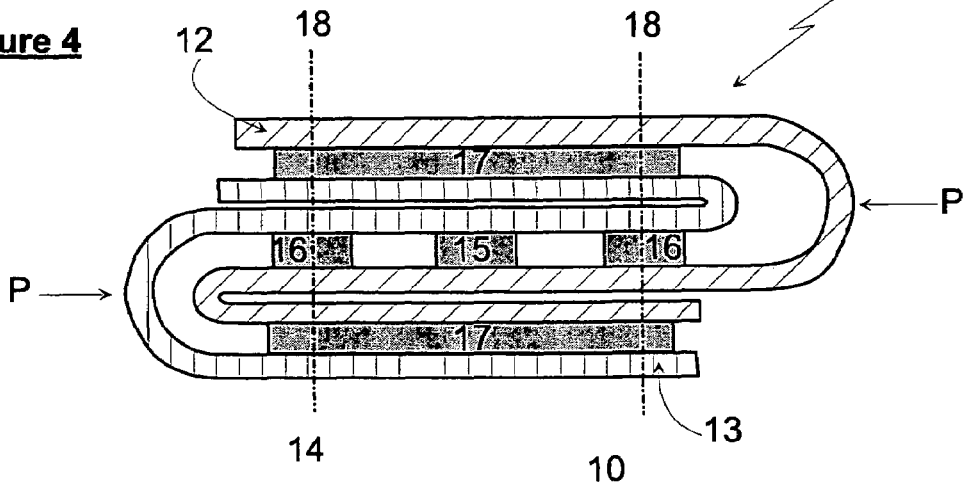
FIG. 4 is a schematic sectional view illustrating the folding of the flat cable structure in order to produce a shielded flat cable according to the present invention.

As may be better seen in FIG. 4, the plane structure 11 is folded (at P) twice on itself (in the longitudinal direction) in order to constitute the shielded flat cable according to the invention. More precisely, the structure 11 is rolled up around the track 15 to be protected in such a way that this track to be protected is surrounded (FIG. 4) by the two lateral shielding tracks 16 and is covered by the two, lower and upper shielding tracks 17. Consequently, a shielding cage is formed (on the four sides of the track 15 to be protected) which shields against the electromagnetic radiation around the track 15 to be protected.

As shown in FIG. 4, connection means (for example crimping connections 18) are provided through the shielding tracks 16 and 17. In FIG. 4, these electrical connection means are not shown in detail—they are simply depicted by dot-dash lines 18 (in order not to overload the figure).

It should be noted that once the structure 11 has been folded twice onto itself, it forms a shielded cable ready to be used. This is because no additional protection of the shielding faces is necessary, since the cable thus produced is already protected by the lower and upper insulating films.

It should also be noted that the connection means 18 make it possible to stiffen the structure of the shielded cable, which therefore requires no particular retention means for keeping the shape that it has been given by the folding. However, it is of course also possible to bond the lower and upper insulating films together in order to ensure better retention of the assembly. For the same purpose, it is also possible to place the flat cable in an insulating jacket.

In the example shown, the shielded flat cable is designed to form an antenna. In this case, the active part of this antenna is not shielded (this is why one of the ends of the track 15 to be protected is devoid of any shielding (on the left in FIG. 3). Again, in this FIG. 3, the right-hand part of the shielded cable is designed to be connected to a connector. In this case, one of the shielding tracks is accessible for connection with the connector (this is why in the right-hand part of FIG. 3 one of the shielding tracks and the track 15 to be protected extend beyond the shielded part).

It should be noted in the example shown that the track 15 to be protected is surrounded by four shielding tracks. Of course, a shielded cable such as this could accommodate more than one track to be protected. In this case, the dimensions of each of the tracks would be adapted in order to allow appropriate protection. Of course, the present invention is not limited to the embodiment described and illustrated.

The invention claimed is:

1. A flat electrical cable shielded against electromagnetic radiation, produced from a structure (11) comprising a plurality of flat conducting tracks (14) that are sandwiched between a lower insulating film (13) and an upper insulating film (12), said shielded flat cable (10) being one wherein some of the flat tracks are shielding tracks (16, 17) designed to protect at least one electrical track (15) against electromagnetic radiation, said shielding tracks (16, 17) being folded around the connection (15) to be protected, in order to form an insulation-covered shielded flat cable.

2. The flat cable as claimed in claim 1, which is further provided with inter-track connection means (18), connecting together the various shielding tracks (16, 17).

3. The flat cable as claimed in claim 2, which has two longitudinal folding regions (P) where the cable is folded on itself.

4. The flat cable as claimed in claim 2, which is provided with at least four shielding tracks (16, 17).

5. The flat cable as claimed in claim 2, wherein the tracks (14) have different widths.

6. The flat cable as claimed in claim 1, which has two longitudinal folding regions (P) where the cable is folded on itself.

7. The flat cable as claimed in claim 6, which is provided with at least four shielding tracks (16, 17).

8. The flat cable as claimed in claim 6, wherein the tracks (14) have different widths.

9. The flat cable as claimed in claim 1, which is provided with at least four shielding tracks (16, 17).

10. The flat cable as claimed in claim 9, wherein the tracks (14) have different widths.

11. The flat cable as claimed in claim 1, wherein the tracks (14) have different widths.

12. A method of producing a flat cable as claimed claim 1, which includes the following step:

longitudinal folding (P) a flat cable structure (11) twice on itself, said flat cable structure comprising a plurality of flat conducting tracks (14), which are sandwiched between a lower insulating film (13) and an upper insulating film (12), in such a way that, after folding, at least one track (15) to be protected is surrounded on its four sides by shielding tracks (16, 17).

13. The method as claimed in claim 12, which further includes a step of crimping connection means (18) between the various shielding tracks (16, 17).

14. The method as claimed in claim 13, which further includes a step of bonding the lower (13) and upper (12) insulating films together.

15. The method as claimed in claim 12, which further includes a step of bonding the lower (13) and upper (12) insulating films together.

* * * * *